US012765736B2

(12) United States Patent
Li et al.

(10) Patent No.: US 12,765,736 B2
(45) Date of Patent: Oct. 20, 2026

(54) BASE STATION AND CLEANING ROBOT SYSTEM

(71) Applicant: Beijing Roborock Technology Co., Ltd., Beijing (CN)

(72) Inventors: Xing Li, Beijing (CN); Pan Cheng, Beijing (CN); Zhimin Yang, Beijing (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 314 days.

(21) Appl. No.: 18/684,560

(22) PCT Filed: Apr. 7, 2022

(86) PCT No.: PCT/CN2022/085650
§ 371 (c)(1),
(2) Date: Feb. 16, 2024

(87) PCT Pub. No.: WO2023/019975
PCT Pub. Date: Feb. 23, 2023

(65) Prior Publication Data

US 2024/0349970 A1 Oct. 24, 2024

(30) Foreign Application Priority Data

Aug. 20, 2021 (CN) ..... 202121975448.7

(51) Int. Cl.
*A47L 11/40* (2006.01)

(52) U.S. Cl.
CPC ..... *A47L 11/4025* (2013.01); *A47L 11/4011* (2013.01); *A47L 2201/024* (2013.01)

(58) Field of Classification Search
CPC ..... A47L 2201/024; A47L 11/4011; A47L 11/4025
(Continued)

(56) References Cited

U.S. PATENT DOCUMENTS

2020/0121153 A1 4/2020 Letsky
2022/0346619 A1* 11/2022 Huang ..... A47L 11/4016

FOREIGN PATENT DOCUMENTS

CN 209854645 A 12/2019
CN 210173549 U 3/2020
(Continued)

OTHER PUBLICATIONS

Extended European Search Report issued in corresponding European Patent Application No. 22857293.9, dated Aug. 5, 2025.
(Continued)

*Primary Examiner* — Katina N. Henson
(74) *Attorney, Agent, or Firm* — Morgan, Lewis & Bockius LLP

(57) ABSTRACT

A base station for cleaning a cleaning system of a cleaning robot is provided. The base station includes a base station body, a cleaning assembly and at least one track-cleaning member. The base station body is provided with at least one track groove. The cleaning assembly is configured to run along the at least one track groove and is provided with a cleaning member. The cleaning member is configured to clean the cleaning system of the cleaning robot by interfering with the cleaning system of the cleaning robot. The at least one track-cleaning member is configured to run along the at least one track groove to clean the at least one track groove.

16 Claims, 8 Drawing Sheets

(58) Field of Classification Search
USPC ..... 15/319
See application file for complete search history.

(56) References Cited

FOREIGN PATENT DOCUMENTS

| | | | | | |
|---|---|---|---|---|---|
| CN | 112493946 | A | * | 3/2021 | ..... A47L 11/40 |
| CN | 112515540 | A | | 3/2021 | |
| CN | 213282758 | U | | 5/2021 | |
| CN | 112869673 | A | | 6/2021 | |
| CN | 112879773 | A | * | 6/2021 | ..... F16M 11/425 |
| CN | 113040664 | A | | 6/2021 | |
| CN | 113180559 | A | | 7/2021 | |
| CN | 215838852 | U | | 2/2022 | |
| CN | 215838853 | U | | 2/2022 | |
| EP | 3542695 | A1 | | 9/2019 | |
| JP | 2006-307420 | A | | 11/2006 | |
| JP | 2016-008754 | A | | 1/2016 | |
| JP | 2016-064387 | A | | 4/2016 | |
| JP | 2020-044463 | A | | 3/2020 | |
| WO | 2021/137476 | A1 | | 7/2021 | |

OTHER PUBLICATIONS

International Search Report issued in the corresponding Application No. PCT/CN2022/085650 mailed Jun. 17, 2022.
Notice of Allowance issued in corresponding Japanese Patent Application No. 2024-507961, dated Feb. 12, 2025.

* cited by examiner

BASE STATION AND CLEANING ROBOT SYSTEM

CROSS-REFERENCE TO RELATED APPLICATION

The present application is a U.S. National Stage of International Application No. PCT/CN2022/085650, filed on Apr. 7, 2022, which claims priority to the Chinese Patent Application No. 202121975448.7 filed on Aug. 20, 2021, and the contents of which are hereby incorporated herein by reference in their entireties as part of this application.

TECHNICAL FIELD

The present disclosure relates to the field of smart home technologies, more particularly to a base station and a cleaning robot system.

BACKGROUND ART

For current base stations, a movable cleaning member is generally provided to clean a flat mop of a sweeping/mopping multifunctional cleaning robot. However, in the cleaning procedure, residue may be accumulated in a track groove where the cleaning member runs, thereby affecting the reliability of running of the cleaning member.

SUMMARY OF THE INVENTION

A series of concepts in simplified form is introduced in this section, and will be described in further detail in the Detailed Description section. This section of the present disclosure is not intended to limit key features and necessary technical features of the technical solutions for which protection is sought, and is not intended to determine the protection scope of the technical solutions for which protection is sought.

According to embodiments of a first aspect. a base station is provided. The base station is configured to clean a cleaning system of a cleaning robot. The base station includes: a base station body provided with at least one track groove; a cleaning assembly configured to run along the at least one track groove and provided with a cleaning member, wherein the cleaning member is configured to clean the cleaning system of the cleaning robot by interfering with the cleaning system of the cleaning robot; and at least one track-cleaning member configured to run along the at least one track groove to clean the at least one track groove.

Optionally, the at least one track-cleaning member is provided on the cleaning assembly, and includes a sweeping member inside the at least one track groove.

Optionally, the at least one track-cleaning member is provided at a side of the cleaning assembly.

Optionally, the at least one track-cleaning member is provided slantwise toward an outer side of the cleaning assembly.

Optionally, there are two track grooves, and the two track grooves are provided opposite each other along a lateral direction of the base station body.

Optionally, the cleaning assembly includes a bracket capable of running along the track grooves, and track-cleaning members are provided at two ends of the bracket.

Optionally, one of the track-cleaning members is provided at an end of the bracket facing the same track groove, and the track-cleaning member is provided slantwise toward an end portion of the track groove and disposed at a location of the bracket close to the end portion; and/or two of the track-cleaning members are provided at an end of the bracket facing the same track groove, the two of the track-cleaning members include a first track-cleaning member and a second track-cleaning member, the first track-cleaning member is provided slantwise toward a first end portion of the track groove and is disposed at a location of the bracket close to the first end portion, and the second track-cleaning member is provided slantwise toward a second end portion of the track groove and is disposed at a location of the bracket close to the second end portion.

Optionally, the at least one track-cleaning member includes a mounting portion connected to the sweeping member, the mounting portion being detachably connected to the cleaning assembly.

Optionally, the base station further includes a rack provided on the base station body, wherein the cleaning assembly includes a driving portion and a first gear linked to the driving portion, the first gear is disposed at two ends of the bracket, and the driving portion is configured to drive the first gear to engage with the rack to drive the bracket to run along the at least one track groove.

Optionally, the rack is provided inside the at least one track groove.

Optionally, the base station body includes a cleaning sink below the cleaning assembly, the at least one track groove is provided on an inner wall of the cleaning sink, a lower inner wall surface of the track groove is tilted downward toward an interior of the cleaning sink, and the rack is provided on an upper wall surface of the track groove.

Optionally, the cleaning sink is provided with a drain outlet, and the cleaning assembly further includes a clearing member facing a bottom of the cleaning sink, the clearing member being configured to bring residue in the cleaning sink toward the drain outlet.

Optionally, the base station further includes a track detachably connected to the base station body, the track is provided with the at least one track groove and the rack, and the track is formed with the rack integrally or separately.

Optionally, a supporting portion is provided on the bracket, the supporting portion is spaced from the first gear in an extending direction of the track groove and includes a supporting wheel provided away from the bracket, the supporting wheel being in the track groove.

Optionally, the cleaning assembly further includes: a first cleaning member and a second cleaning member that are provided on the bracket, wherein the first cleaning member and the second cleaning member remove residue from the cleaning system by interfering with the cleaning system of the cleaning robot.

Optionally, the driving portion is further drivingly connected with the second cleaning member to drive the second cleaning member to rotate relative to the bracket.

Optionally, the cleaning assembly further includes: a liquid-releasing device configured to release a cleaning liquid, the cleaning liquid being accommodated in the cleaning sink after cleaning the cleaning system.

According to embodiments of a second aspect, a cleaning robot system is provided. The cleaning robot system includes: a cleaning robot including a cleaning system, and the base station according to any one of implementations of the first aspect, the cleaning assembly being configured to clean the cleaning system.

BRIEF DESCRIPTION OF THE DRAWINGS

The following accompanying drawings of the present disclosure are taken herein as a part of the embodiments of the present disclosure for the purpose of understanding the present disclosure. The accompanying drawings illustrate embodiments of the present disclosure and descriptions thereof for explaining the principles of the present disclosure.

In the drawings.

LIST OF REFERENCE NUMERALS

10—cleaning robot, 110—machine body, 111—forward portion, 112—backward portion, 120—perception system, 121—determining device, 122—buffer, 130—control module, 140—driving system, 141—driving wheel module, 142—driven wheel, 150—cleaning system, 151—dry cleaning system, 152—side brush, 153—wet-cleaning system, 1531—cleaning head, 1532—driving unit, 1533—driving platform, 1534—supporting platform, 160—energy system, 170—human-computer interaction system, 20—base station, 21—base station body, 211—drain outlet, 212—cleaning sink, 22—track, 221—rack, 222—track groove, 223—first inner wall surface, 30—cleaning assembly, 31—first cleaning member, 32—bracket, 33—second cleaning member, 34—driving portion, 341—first gear, 342—motor, 345—first rotating shaft, 35—liquid-releasing device, 351—liquid outlet, 36—clearing member, 37—supporting portion, 38—track-cleaning member, 381—sweeping member, 382—mounting portion, 383—first track-cleaning member, 382—second track-cleaning member, 40—liquid-supplying portion.

DETAILED DESCRIPTION

In the description that follows, an abundance of specific details are given to provide a more thorough understanding of technical solutions of the present disclosure. However, it may be apparent to those skilled in the art that technical solutions of the present disclosure can be implemented without one or more of these details.

It should be noted that the terms used herein are merely intended to describe example embodiments and are not intended to limit example embodiments according to the present disclosure. As used here, a singular form is also intended to include a plural form, unless the context clearly indicates otherwise. It should also be understood that the terms "comprising" and/or "including" as used in this specification may indicate the presence of the features, integers, steps, operations, components and/or assemblies, which does not exclude the presence or addition of one or more other features, integers, steps, operations, components, assemblies and/or combinations thereof.

Example embodiments of the present disclosure will be described herein in greater detail with reference to the accompanying drawings. However, these example embodiments may be implemented in a variety of different forms and should not be construed as being limited to the embodiments set forth herein. It should be understood that these embodiments are provided to make the present disclosure thorough and complete and to fully communicate the ideas of these example embodiments to those of ordinary skill in the art.

Figure 1:
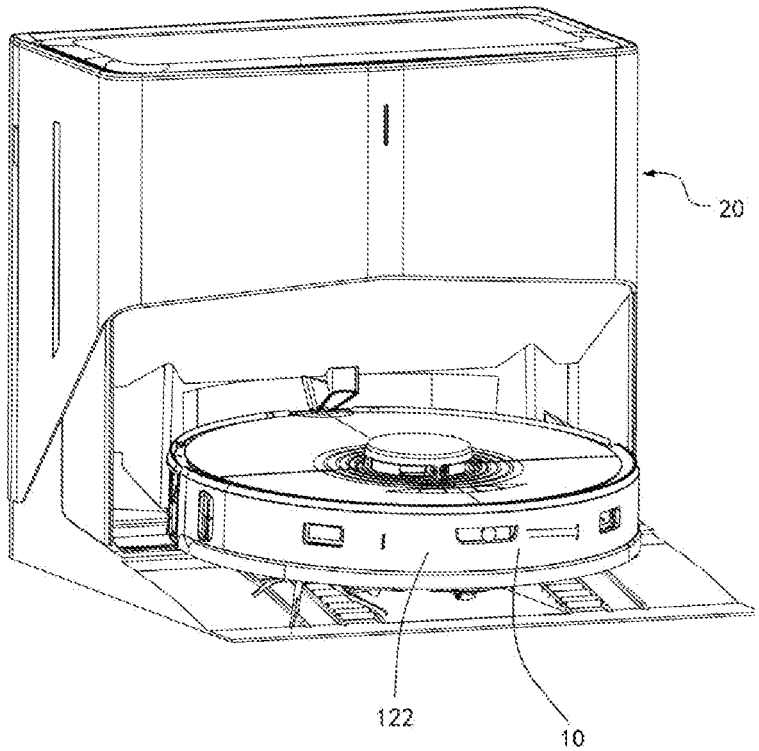
FIG. 1 is a schematic structural diagram of a cleaning robot system according to an optional embodiment of the present disclosure.

As shown in FIG. 1 to FIG. 9, embodiments of the present disclosure provide a base station 20 and a cleaning robot 10 system. As shown in FIG. 1, the cleaning robot system includes a cleaning robot 10 and a base station 20. That is, the base station 20 is used in cooperation with the cleaning robot 10.

Figure 2:
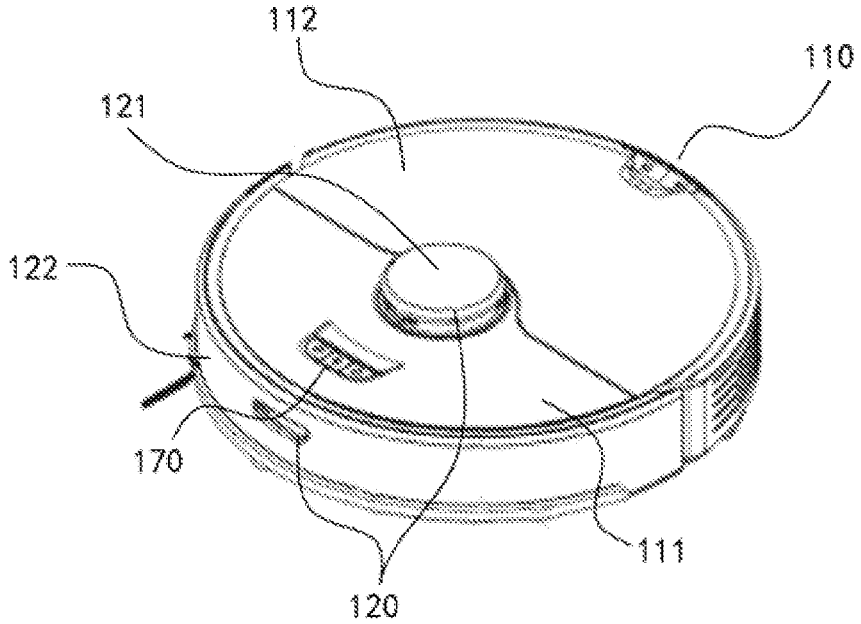
FIG. 2 is a schematic structural diagram of a cleaning robot according to an optional embodiment of the present disclosure.
Figure 3:
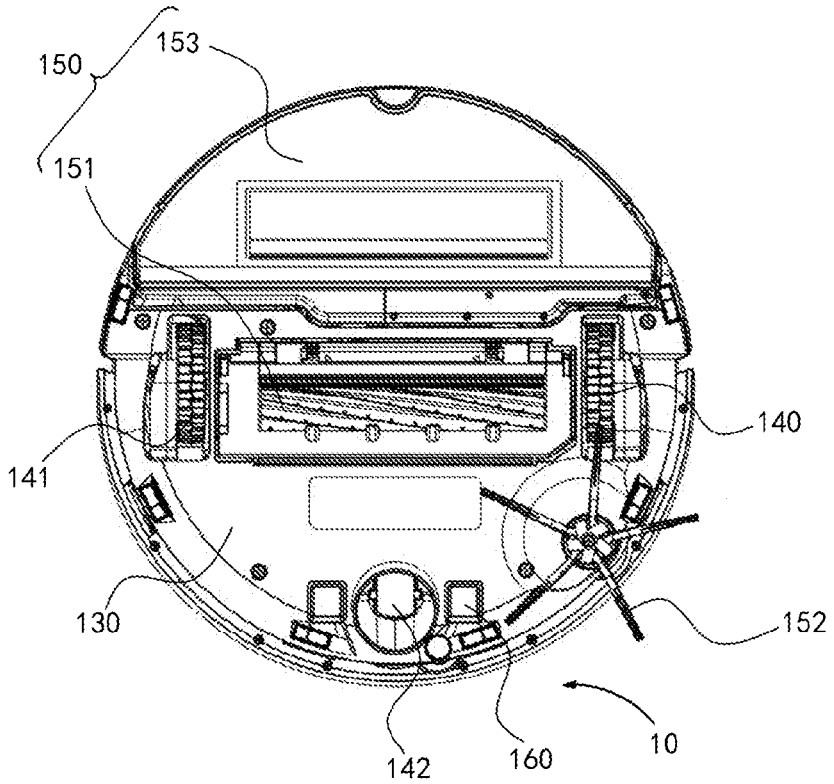
FIG. 3 is a schematic structural diagram of a perspective of an embodiment shown in FIG. 2.

Furthermore, as shown in FIGS. 2 and 3, the cleaning robot 10 may include a machine body 110, a perception system 120, a control module 130, a driving system 140, a cleaning system 150, an energy system 160, and a human-computer interaction system 170. It will be appreciated that the cleaning robot 10 may be a self-moving cleaning robot or other cleaning robot that meets the requirements. The self-moving cleaning robot is an apparatus that automatically performs cleaning in a region to be cleaned without a user operation. When the self-moving cleaning robot starts working, the self-moving cleaning device departs from the base station 20 to perform the cleaning task. The self-moving cleaning robot 10 may return to the base station 20 for charging or other operations when the self-moving cleaning robot 10 completes its cleaning task or other situations occur that require aborting the cleaning task.

As shown in FIG. 2, the machine body 110 includes a forward portion 111 and a backward portion 112, both having a nearly circular shape (both the front and backward portions being circular), or the forward portion 111 and the backward portion 112 may have other shapes, including but not limited to a nearly D-shaped form with a square front and circular rear and a rectangular or square shape with a square front and square rear.

As shown in FIG. 2, the perception system 120 includes: a position-determining device 121 provided on the machine body 110, a collision sensor and a proximity sensor provided on a buffer 122 of the forward portion 111 of the machine body 110, a precipice sensor provided on a lower portion of the machine body 110, and sensing devices such as a magnetometer, an accelerometer, a gyroscope, and an odometer provided inside the machine body 110 for providing various location information and motion-state information of the machine to the control module 130. The position-determining device 121 includes, but is not limited to, a camera, or a laser distance sensor (LDS).

As shown in FIG. 2, the forward portion 111 of the machine body 110 carries the buffer 122. During cleaning, when a driving wheel module 141 propels the cleaning robot 10 to travel on the ground, the buffer 122 detects one or more events in a traveling path of the cleaning robot 10 via a sensor system disposed thereon, e.g., an infrared sensor. The cleaning robot 10 may control the driving wheel module 141 based on an event, such as obstacle and wall, detected by the buffer 122 to cause the cleaning robot 10 to respond to the event, for example to move away from the obstacle.

The control module 130 is provided on a circuit main board within the machine body 110 and includes a computational processor (such as a central processing unit or an application processor) which communicates with a non-transitory memory (such as a hard disk, a flash memory, or a random access memory). The application processor draws an instant map of the environment in which the cleaning robot 10 is located using a positioning algorithm, such as simultaneous localization and mapping (SLAM), based on the obstacle information fed back by the laser ranging device. In addition, based on distance information and speed information as fed back by sensing devices such as the sensor, the precipice sensor, the magnetometer, the accelerometer, the gyroscope and the odometer provided on the buffer 122, a current operation state, a current location, and a current pose of the cleaning robot 10, such as crossing a threshold, getting on a carpet, locating at an edge of a precipice, being trapped from above or below, having a full dust box or being picked up, can be comprehensively determined. In addition, specific next-step action strategies may be given for different situations so that the cleaning robot 10 has a better cleaning performance and can provide good user experience.

As shown in FIG. 3, the driving system 140 may manipulate the machine body 110 to travel across the ground based on a driving command having distance and angle information, such as x, y and θ components. The driving system 140 includes a driving wheel module 141, and the driving wheel module 141 may control a left wheel and a right wheel simultaneously. In order to control the motion of the machine more precisely, the driving wheel module 141 preferably includes a left driving wheel module and a right driving wheel module. The left and right driving wheel modules are provided along a lateral axis defined by the machine body 110. In order for the cleaning robot 10 to move on the ground more stably or have a stronger movement ability, the cleaning robot 10 may include one or more driven wheels 142 that include but are not limited to a universal wheel. The driving wheel module 141 includes a traveling wheel, a driving motor, and a control circuit to control the driving motor, and the driving wheel module 141 may also be connected to a circuit for measuring the driving current and an odometer. The driving wheel may have a biased drop suspension system, is fastened in a movable manner, such as being attached to the machine body 110 in a rotatable manner, and receives a spring bias which is biased downward and away from the machine body 110. The spring bias allows the driving wheel to maintain contact with the ground and maintain traction with a certain landing force, and meanwhile cleaning elements of the cleaning robot 10 may also contact the ground with a certain pressure.

The energy system 160 includes a rechargeable battery, such as a nickel-hydride battery and a lithium battery. The rechargeable battery may be connected with a charging control circuit, a battery pack charging temperature-detecting circuit and a battery undervoltage monitoring circuit. The charging control circuit, the battery pack charging temperature-detecting circuit and the battery undervoltage monitoring circuit are then connected to a single-chip microcomputer control circuit. A host is connected to a charging pile through a charging electrode disposed on a side of a body or below a body for charging.

A human-computer interaction system 170 includes buttons that are on a panel of the host and used by a user to select functions. The human-computer interaction system 170 may further include a display screen and/or an indicator light and/or a speaker that present a current state or function option of the robot to the user. The human-computer interaction system 170 may further include a mobile client program. For a route navigation type automatic cleaning apparatus, a mobile client may present a map of the environment where the apparatus is located and a position of the robot to the user, which may provide richer and more user-friendly function options to the user.

The cleaning system 150 may be a dry cleaning system 151 and/or a wet-cleaning system 153.

As shown in FIG. 3, the dry cleaning system 151 according to embodiments of the present disclosure may include a rolling brush. a dust box, a blower and an air outlet. The rolling brush, having a certain interference with the ground, sweeps up garbage on the ground and rolls up the garbage to the front of a dust suction inlet between the rolling brush and the dust box, and then the garbage is sucked into the dust box by air having a suction force, which is generated by the blower and passes through the dust box. The dry cleaning system 151 may further include a side brush 152 having a rotary shaft angled relative to the ground for moving debris into a region of the rolling brush of the cleaning system 150.

Figure 4:
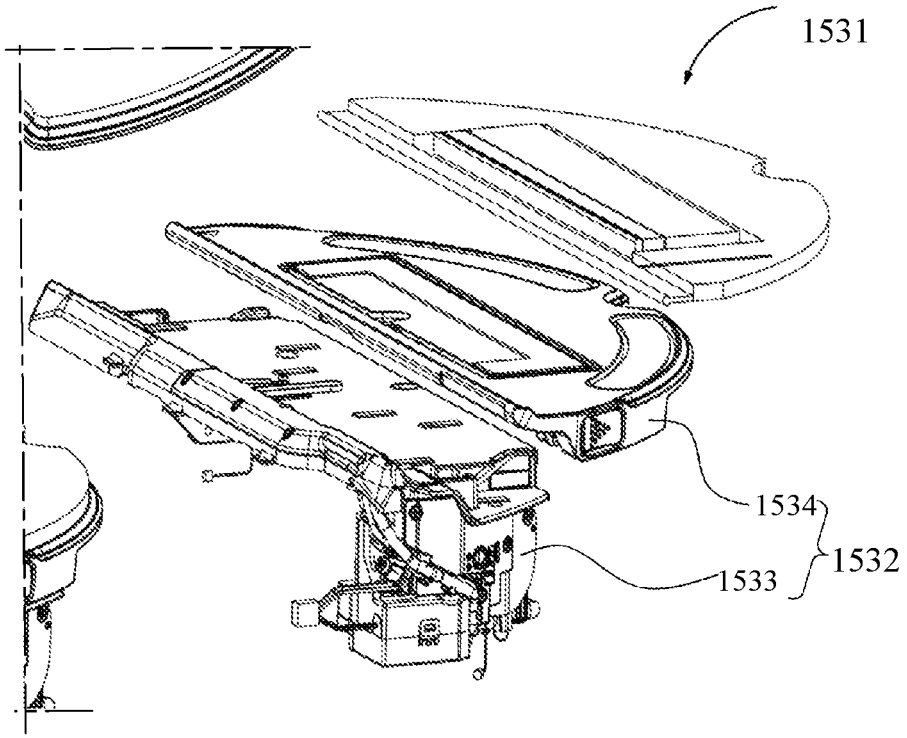
FIG. 4 is a partial schematic exploded diagram of the embodiment shown in FIG. 3.

As shown in FIG. 3 and FIG. 4, the wet-cleaning system 153 according to embodiments of the present disclosure may include a cleaning head 1531, a driving unit 1532, a water delivery mechanism, and a liquid storage tank. The cleaning head 1531 may be provided below the liquid storage tank, and the cleaning liquid inside the liquid storage tank is transferred to the cleaning head 1531 through the water delivery mechanism to enable the cleaning head 1531 to wet-clean the plane to be cleaned. In other embodiments of the present disclosure, the cleaning liquid inside the liquid storage tank may also be sprayed directly onto the plane to be cleaned, and the cleaning head 1531 achieves cleaning of the plane by applying the cleaning liquid evenly.

The cleaning head 1531 is configured to clean the surface to be cleaned, and the driving unit 1532 is configured to drive the cleaning head 1531 to substantially reciprocate along the target surface, the target surface being a portion of the surface to be cleaned. The cleaning head 1531 reciprocates along a surface to be cleaned, and a surface of the cleaning head 1531 in contact with the surface to be cleaned is provided with a cleaning cloth or a cleaning plate, which generates a high-frequency friction with the surface to be cleaned through reciprocating motion, thereby removing stains on the surface to be cleaned.

Figure 5:
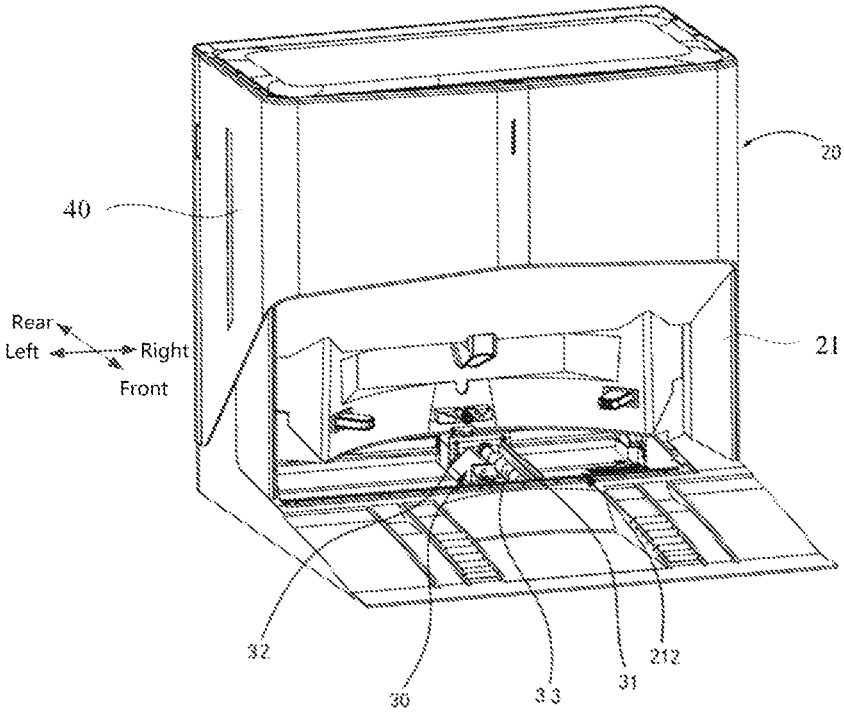
FIG. 5 is a schematic structural diagram of a base station according to an optional embodiment of the present disclosure.

In embodiments according to the present disclosure, as shown in FIG. 5, the base station 20 includes a base station body 21 and a cleaning assembly 30. The cleaning assembly 30 is movably disposed on the base station body 21. Specifically, the cleaning assembly 30 is capable of moving relative to the base station body 21. For example, the cleaning assembly 30 can reciprocate along a left-right direction of the base station 20. The left-right direction of the base station 20 is as shown by the solid line arrow in FIG. 5. The direction shown by the dotted-line arrow in FIG. 5 is a front-rear direction of the base station 20. The cleaning assembly 30 includes a cleaning member for removing residue from the cleaning system 150 by interfering with the cleaning system 150 of the cleaning robot 10.

Specifically, as shown in FIG. 8, FIG. 9, FIG. 10 and FIG. 11, the base station body 21 is provided with a track groove 222. The cleaning assembly 30 is configured to run along the track groove 222. It will be appreciated that the cleaning assembly 30 is configured to be able to run along the track groove 222 reciprocally, such that the cleaning assembly 30 can move along the base station body 21 and thus interfere with the cleaning system 150 of the cleaning robot 10 to achieve automatic cleaning of the cleaning system 150. In other words, the cleaning robot 10 can be automatically cleaned on the cleaning assembly 30 of the base station 20, which can eliminate operations such as manually cleaning the cleaning system 150 or replacing it with a new cleaning system 150, thereby simplifying the manual operation, improving the manual cleaning experience, and reducing the cleaning cost. Thus, the cleaning robot 10 is suitable for popularization and application.

Figure 14:
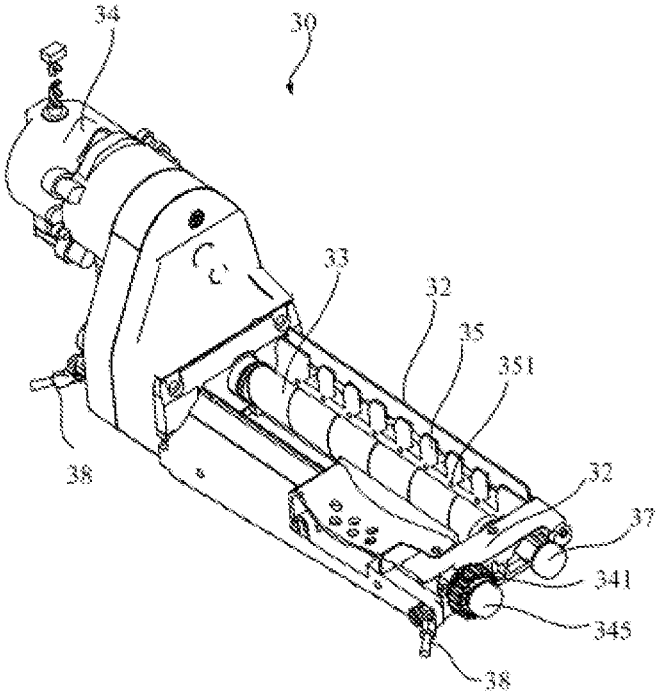
FIG. 14 is a schematic structural diagram of a cleaning assembly according to an optional embodiment of the present disclosure.
Figure 15:
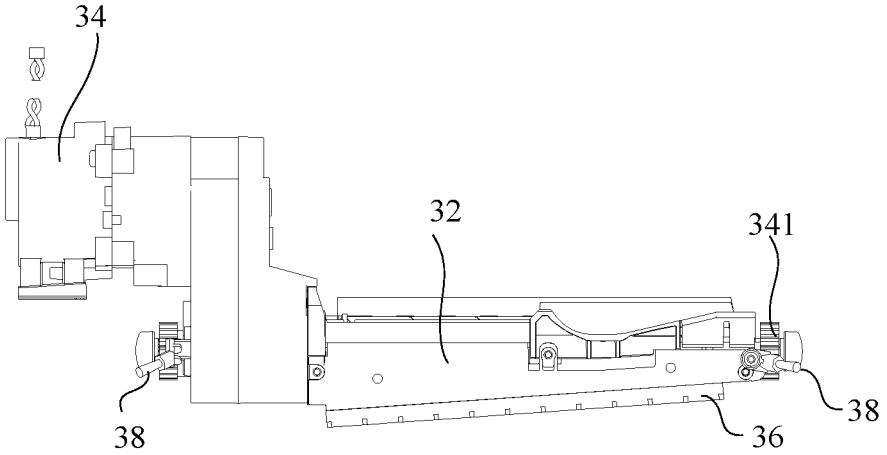
FIG. 15 is a schematic structural diagram of a perspective of the embodiment shown in FIG. 14.
Figure 16:
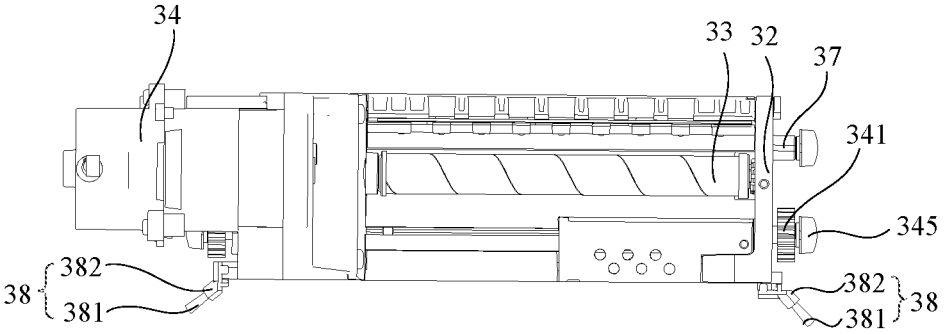
FIG. 16 is a structural schematic diagram of another perspective of the embodiment shown in FIG. 14.

As shown in FIG. 14, FIG. 15 and FIG. 16, the base station 20 further includes a track-cleaning member 38 for cleaning the track groove 222. Since residue (e.g., trash and sewage) adhered to and left inside the track groove 222 may corrode and damage the track groove and affect the smoothness of running of the cleaning assembly 30 along the track groove 222, cleaning the track groove 222 with the track-cleaning member 38 can discharge residue in the track groove 222 in a timely manner, which can reduce the possibility of residue being left and accumulated in the track groove 222 and thus improve the smoothness and reliability of running of the cleaning assembly 30 in the track groove 222. As a result, the cleaning efficiency of the cleaning assembly 30 can be improved, the service life of the track groove 222 can be lengthened, and the reliability of the base station 20 can be improved.

Specifically, the track-cleaning member 38 may be provided separately from the track groove 222. For example, the track-cleaning member 38 may be provided separately or provided detachably on the base station body 21. When the track groove 222 is dirty, or the base station body 21 has residue left in the track groove 222 after a period, the operator can hold the track-cleaning member 38 to sweep the track groove 222 and can remove the track-cleaning member 38 from the track groove 222 for storage after the sweeping, which is simple in operation. It will be appreciated that the track-cleaning member may also be provided on other structures that meet the requirements.

In some possible embodiments according to the present disclosure, as shown in FIG. 14 and FIG. 16, the track-cleaning member 38 may be provided on the cleaning assembly 30. That is, the track-cleaning member 38 moves as the cleaning assembly 30 moves along the track groove 222. Therefore, when the cleaning assembly 30 runs along the track groove 222 to clean the cleaning system 150 of the cleaning robot 10, the track-cleaning member 38 is used to clean the track groove 222, which simplifies the operation of manually holding the track-cleaning member 38 in cleaning the track groove 222, increases the function of the cleaning assembly 30, and is thereby suitable for popularization and application.

Further, the track-cleaning member 38 is provided on the cleaning assembly 30 and includes a brush portion 381 inside the track groove 222. Therefore, when the cleaning assembly 30 runs along the track groove 222, the brush portion 381 of the track-cleaning member 38 inside the track groove 222 also moves along the track groove 222 to clean the track groove 222, which avoids the corrosion and rusting of the track groove 222 caused by residue left in the track groove 222 for a long time, and helps to lengthen the service life of the track groove 222. Meanwhile, the residue can be prevented from affecting the smoothness of running of the cleaning assembly 30 relative to the track groove 222, which helps to improve the smoothness and reliability of running of the cleaning assembly 30 relative to the track groove 222, and thereby helps to ensure a higher cleaning efficiency of the cleaning assembly 30. It will be appreciated that the brush portion 381 may be bristles, a rubber sheet, a squeegee strip or other cleaning structures that meet the requirements, which is not specifically limited in the present disclosure.

In aforesaid embodiments, the track-cleaning member 38 is provided at a side of the cleaning assembly 30, and an end portion of the cleaning assembly 30 located between two sides is used to movably connect with the track groove 222. In this way, when the cleaning assembly 30 moves relative to the track groove 222, the track-cleaning member 38 provided at the side of the cleaning assembly 30 is disposed in front of the running direction of the end portion of the cleaning assembly 30. That is, the track-cleaning member 38 can sweep a part of the track groove 222 matching with the end portion of the cleaning assembly 30 in advance, which helps to improve the smoothness and reliability of running of the cleaning assembly 30 along the track groove 222. In this embodiment, the track-cleaning member 38 is provided slantwise toward the outside of the cleaning assembly 30. That is, the track-cleaning member 38 is provided slantwise toward the end portion of the track groove 222 along the extending direction of the track groove 222, which helps to improve the thoroughness and effectiveness of the track-cleaning member 38 in cleaning the track groove 222. For example, when the track-cleaning member 38 is provided on the cleaning assembly 30 in a direction perpendicular to the extending direction of the track groove 222, namely when the track-cleaning member 38 is provided in perpendicular to the moving direction of the cleaning assembly 30, the track-cleaning member 38 tends to push impurities within the track groove 222 to two ends of the track groove 222 with the left-right movement of the cleaning assembly 30 along the track groove 222, which cannot effectively remove the debris from the track groove 222. In this embodiment, the track-cleaning member 38 is provided slantwise toward the outside of the cleaning assembly 30, which means that the track-cleaning member 38 is provided slantwise toward the end portion of the track groove 222 along the extending direction of the track groove 222. When the cleaning assembly 30 moves in a left-right direction along the track groove 222, the track-cleaning member 38 can better clear out the impurities in the track groove 222 to the outside of the track groove 222, and then improve the thoroughness and effectiveness of the track-cleaning member 38 in cleaning the track groove 222, which helps to lengthen the service life of the track groove 222 and improve the smoothness and reliability of running of the cleaning assembly 30 along the track groove 222.

Further, there are two track grooves 222, and the two track grooves 222 are provided opposite each other along the lateral direction of the base station body 21. The lateral direction of the base station body 21 is the left-right direction as shown in FIG. 5. The cleaning assembly 30 includes a bracket 32 that can run along the track grooves 222. That is, the extending direction of the track grooves 222 is parallel to the length direction of the base station body 21, and the bracket 32 of the cleaning assembly 30 runs along the two track grooves 222 to ensure the reliability and stability of running of the cleaning assembly 30 relative to the base station body 21. It will be appreciated that the two track grooves 222 are disposed at two sides of the bracket 32.

The track-cleaning member 38 may be distributed on any one side of the bracket 32 facing the track groove(s) 222, or the track-cleaning member 38 may be provided on both sides of the bracket 32 facing the track groove(s) 222, such that the track-cleaning members 38 can clean the two track grooves 222 and further improve the smoothness and reliability of running of the bracket 32 relative to the base station body 21.

In an example of the present disclosure, on one hand, the bracket 32 is provided with a track-cleaning member 38 at a side facing the same track groove 222, which means that one track-cleaning member 38 is utilized to clean one track groove 222. FIG. 14 is a schematic structural diagram of the cleaning assembly 30 according to an embodiment of the present disclosure. In this figure, the track-cleaning member 38 is provided slantwise toward one end portion of the track groove 222. In FIG. 16, the track-cleaning member 38 is provided at a position of the bracket 32 close to a left end portion of the track groove 222, and the track-cleaning member 38 is thereby provided slantwise toward the left end portion of the track groove 222. In other embodiments of the present disclosure, if the track-cleaning member 38 is located at a position of the bracket 32 close to the right end portion of the track groove 222, the track-cleaning member 38 is provided slantwise toward the right end portion of the track groove 222.

When the track-cleaning member 38 is slantwise as provided at the left end portion of the bracket 32, the track-cleaning member 38 as provided slantwise can smoothly remove the residue inside the track groove 222 as the bracket 32 drives the track-cleaning member 38 to move to the left.

Figure 17:
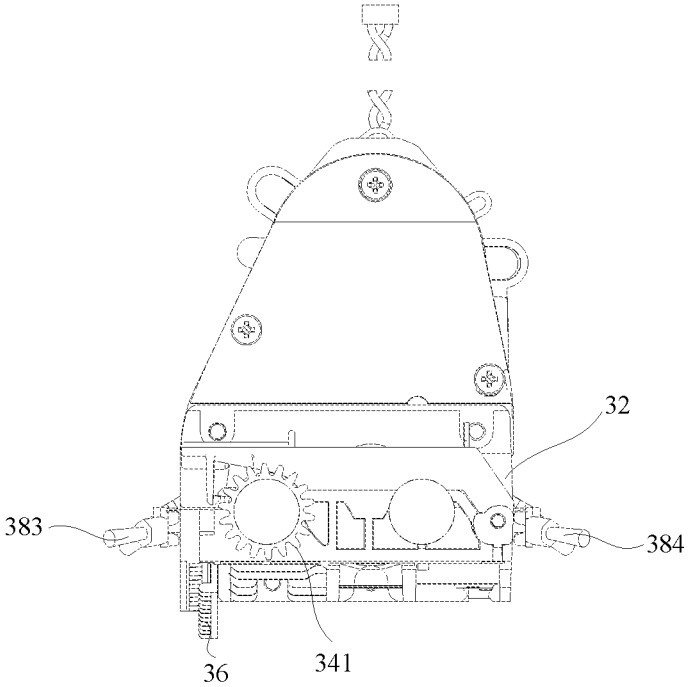
FIG. 17 is a schematic structural diagram of a cleaning assembly according to another optional embodiment of the present disclosure.

On the other hand, as shown in FIG. 17, two track-cleaning members 38 are provided at a side of the bracket 32 facing the same track groove 222. That is, two track-cleaning members 38 are utilized to clean one track groove 222, which helps to improve the cleaning efficiency and cleaning effect of the track groove 222. The two track-cleaning members 38 include a first track-cleaning member 383 and a second track-cleaning member 384. The track groove 222 includes a first end portion and a second end portion. The first track-cleaning member 383 is provided slantwise toward the first end portion of the track groove 222 and is disposed at a position of the bracket 32 close to the first end portion; and the second track-cleaning member 384 is provided slantwise toward the second end portion of the track groove 222 and is disposed at a position of the bracket 32 close to the second end portion. For example, the first end portion may be the left end portion of the track groove 222, and the second end portion may be the right end portion of the track groove 222. The first track-cleaning member 383 is located at a position of the bracket 32 close to the left end portion of the track groove 222, and the second track-cleaning member 384 is located at a position of the bracket 32 close to the right end portion of the track groove 222. That is, the first track-cleaning member 383 is disposed on a left side of the second track-cleaning member 384, the first track-cleaning member 383 is provided slantwise toward the left end portion of the track groove 222, and the second track-cleaning member 384 is provided slantwise toward the right end portion of the track groove 222.

According to the configuration above, when the cleaning assembly 30 moves in the right-left direction along the track groove 222, the track-cleaning members 38 at two ends of the bracket 32 can better remove the impurities out of the track 22. For example, when the cleaning assembly 30 moves to the left along the track groove 222, the residue in the track groove 222 can be pushed toward the left end portion of the track groove 222 under the action of the first track-cleaning member 383. Since the first track-cleaning member 383 is provided slantwise toward the left end portion of the track groove 222, the residue at the left end portion of the track groove 222 can be removed from the track groove 222, thereby ensuring thoroughness in the cleaning of the track groove 222. Conversely, when the cleaning assembly 30 moves to the right along the track groove 222, the residue in the track groove 222 can be pushed toward the right end portion of the track groove 222 under the action of the second track-cleaning member 384. Since the second track-cleaning member 384 is provided slantwise toward the right end portion of the track groove 222, the residue at the right end portion of the track groove 222 can be removed from the track groove 222, thereby ensuring thoroughness in the cleaning of the track groove 222.

By providing a first track-cleaning member 383 and a second track-cleaning member 384 at a side of the bracket 32 facing the same track groove 222, the first track-cleaning member 383 and the second track-cleaning member 384 are located on two sides of the bracket 32 and tilted toward the outside of the bracket. As a result, when the cleaning assembly 30 reciprocates along the track groove 222 in the right-left direction, the two track-cleaning members 38 can thoroughly and reliably remove residue in the respective corresponding parts of the track groove 222 from the track groove 222 and ensure that the track groove 222 has a high degree of cleanliness, which helps to lengthen the service life of the track groove 222 and improve the smoothness and reliability of running of the cleaning assembly 30 relative to the base station body 21, and is thereby suitable for popularization and application.

Figure 18:
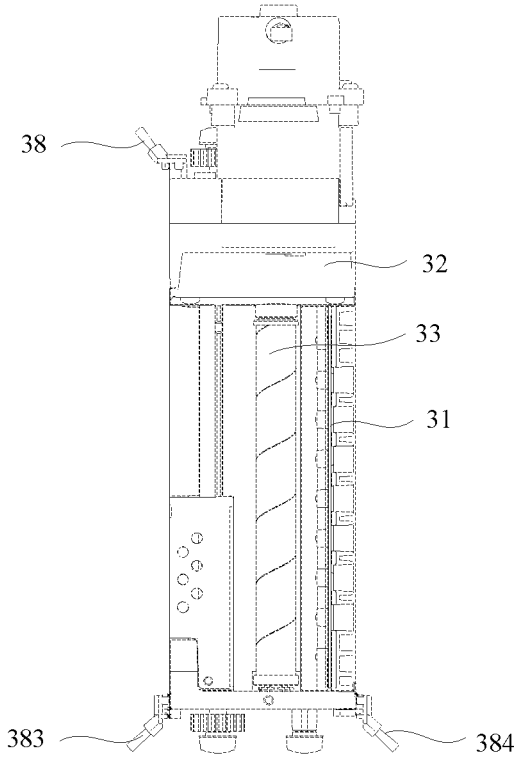
FIG. 18 is a schematic structural diagram of a cleaning assembly according to yet another optional embodiment of the present disclosure.
Figure 19:
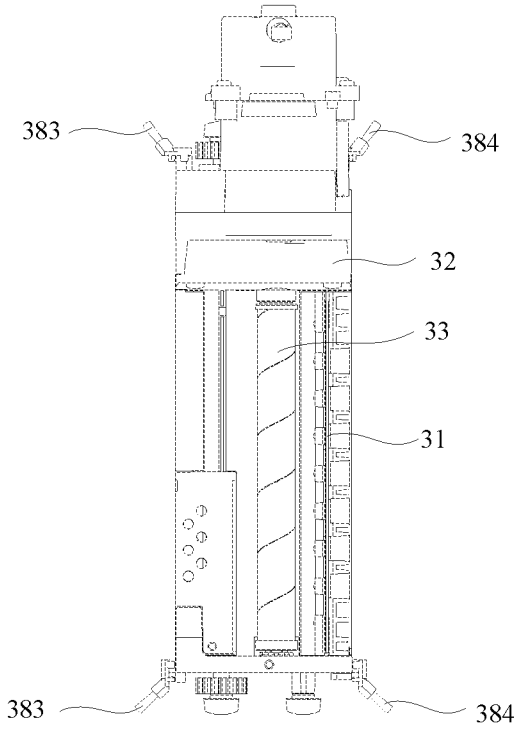
FIG. 19 is a schematic structural diagram of a cleaning assembly according to still another optional embodiment of the present disclosure.

It will be appreciated that, for the two track grooves 222, one or two track-cleaning members 38 may be provided at any one of sides of the bracket 32 facing the two track grooves 222. For example, one track-cleaning member 38 is provided on each side of the bracket 32 as shown in FIG. 15; or, as shown in FIG. 19, two track-cleaning members 38 are provided on each side of the bracket 32; or, as shown in FIG. 18, one track-cleaning member 38 is provided at one side of the bracket 32, and two track-cleaning members 38 are provided at the other side of the bracket 32. The provision of different numbers of track-cleaning members 38 can meet the needs of different structures of the cleaning assembly 30 and different cleaning capacities of the track groove(s) 222, thereby expanding the use range of the product.

In some possible embodiments according to the present disclosure, as shown in FIG. 16, the track-cleaning member 38 includes a mounting portion 382 connected to the brush portion 381. The mounting portion 382 is detachably connected to the cleaning assembly 30. That is, the mounting portion 382 connects the brush portion 381 and the cleaning assembly 30. Since the brush portion 381 is inside the track groove 222, the brush portion 381 can be driven by the mounting portion 382 along the track groove 222 when the cleaning assembly 30 moves along the track groove 222, and the track groove 222 is thereby cleaned, which is simple in structure and low in cost.

With the detachable connection between the mounting portion 382 and the cleaning assembly 30, the mounting portion 382 connected with the brush portion 381 can be detached from the cleaning assembly 30 for maintenance, cleaning, and replacement, which is easy to execute, helps to reduce the cost of maintenance and replacement, and enhances the cleaning experience of the track-cleaning member 38. Specifically, the detachable connection can be achieved by other connection structures meeting the requirements, such as bolt-thread connection or hooks and snaps, which is not specifically limited by the present disclosure.

Figure 7:
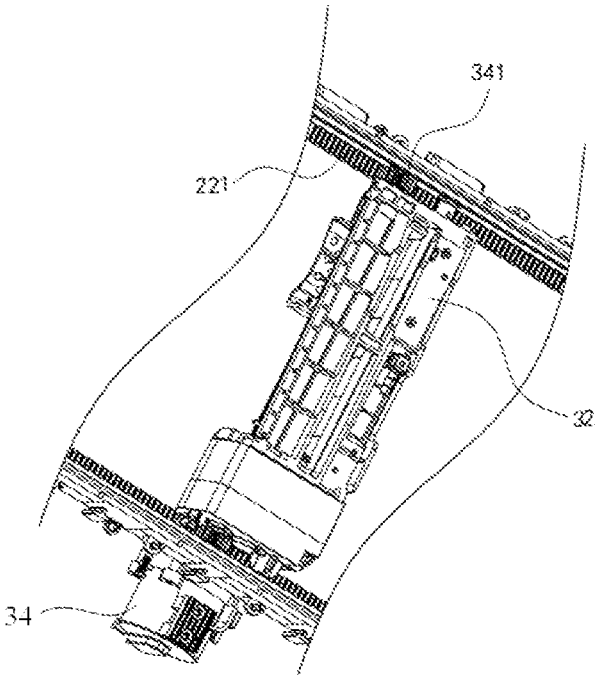
FIG. 7 is a partial schematic structural diagram of another perspective of the embodiment shown in FIG. 6.
Figure 8:
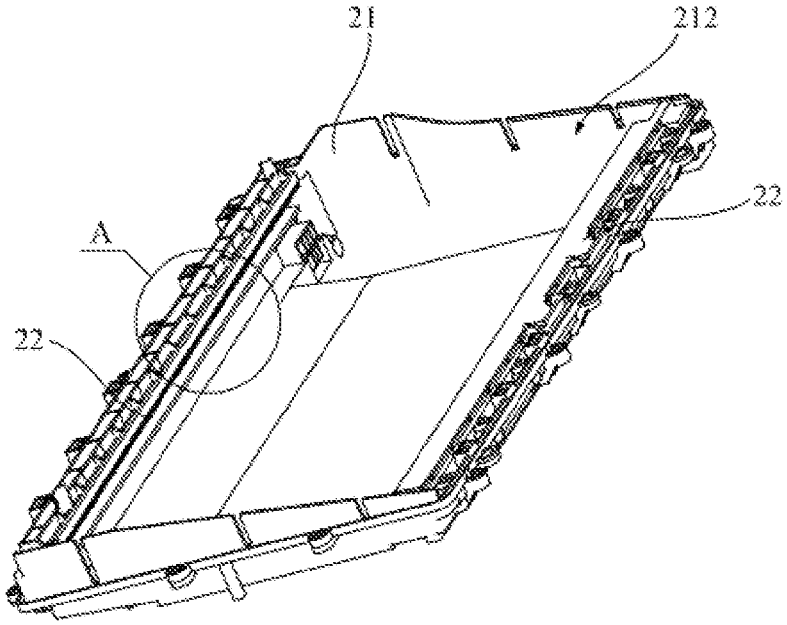
FIG. 8 is a partial schematic structural diagram of a base station body according to an optional embodiment of the present disclosure.

In some possible embodiments according to the present disclosure, as shown in FIGS. 7, 8 and 14, the base station 20 further includes a rack 221 provided on the base station body 21, and the cleaning assembly 30 includes a driving portion 34 and at least one first gear 341 which is in linkage with the driving portion 34. The first gear 341 is disposed at two sides of the bracket 32, and the driving portion 34 is configured to drive the first gear 341 to engage with the rack 221 to enable the bracket 32 to run along the track groove(s) 222. The driving portion 34 can drive the first gear 341 to move on the rack 221 along the forward and reverse directions, and thereby drive the bracket 32 of the cleaning assembly 30 to run reciprocally along the track groove(s) 222, which helps to improve the cleaning effect of the cleaning assembly 30 in cleaning the cleaning system 150.

Through the engagement between the first gear 341 and the rack 221, the driving portion 34 drives the first gear 341 to move in a predetermined direction on the rack 221, and the cleaning assembly 30 runs along the track groove 222.

Specifically, as shown in FIGS. 14 and 15, the driving portion 34 includes a motor 342 and a first rotating shaft 345. The motor 342 and the first rotating shaft 345 are connected with each other in a driving/being driven manner. That is, the motor 342 can work to drive the first rotating shaft 345 to rotate, the first rotating shaft 345 is provided to pass through the bracket 32, and the first gear 341 engaged with the rack 221 is provided at the two ends of the first rotating shaft 345. Therefore, by driving the first rotating shaft 345 to rotate through the motor 342, the first gear 341 at both ends of the first rotating shaft 345 engages with the rack 221 to drive the bracket 32 to move relative to the base station body 21 along the two track grooves 222, thereby realizing the cleaning of the cleaning system 150 of the cleaning robot 10. Further, the motor 342 is capable of driving the first rotating shaft 345 to rotate forwardly or reversely, which in turn allows the bracket 32 to reciprocate along the track groove(s) 222 to improve the cleaning effect of the cleaning assembly 30 for the cleaning system 150.

It will be appreciated that the first gear 341 may be a one-piece structure with the first rotating shaft 345, which simplifies the operation of assembling the first gear 341 with the first rotating shaft 345 and helps to improve the production efficiency. Alternatively, the first gear 341 and the first rotating shaft 345 are of split structure, namely the first gear 341 is detachably provided on the first rotating shaft 345, which facilitates the detaching of the first gear 341 from the first rotating shaft 345 for maintenance and replacement and thereby helps to reduce the cost in maintenance and replacement of parts The present disclosure does not specifically limit the specific manner in which the first gear 341 is connected to the first rotating shaft 345.

Figure 9:
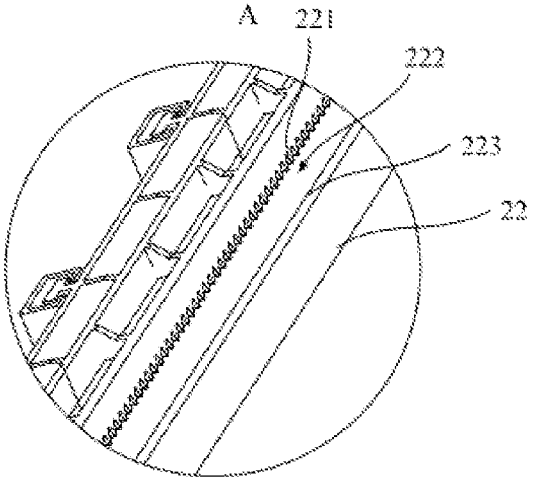
FIG. 9 is a partially enlarged schematic diagram of a part A of the embodiment shown in FIG. 8.
Figure 11:
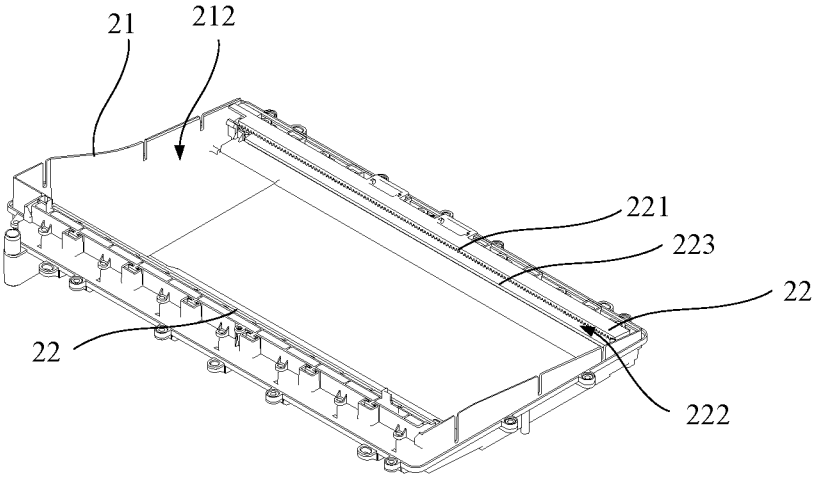
FIG. 11 is a schematic structural diagram of another perspective of the embodiment shown in FIG. 8.

In aforesaid embodiments, as shown in FIGS. 9 and 11, the rack 221 is provided inside the track groove 222, which reduces the space between the rack 221 and the track groove 222 and helps to reduce the volume of the base station body 21, thereby meeting the compact structural requirement of the base station 20 and expanding the application range of the product.

Further, the rack 221 is provided on the upper inner wall of the track groove 222. That is, the rack 221 for determining the running direction and supplying the running power for the cleaning assembly 30 to run relative to the base station body 21 is provided on the upper wall surface of the track groove 222. In addition, the lower wall surface of the track groove 222 opposite the upper wall surface can provide a support force for the cleaning assembly to run relative to the base station body 21. Since the lower wall surface of the track groove 222 is a smoother wall surface as compared to the rack 221, this configuration avoids the rack 221 being provided at the lower wall surface of the track groove 222 and thereby prevents the occurrence of a problem of residue falling on the rack 221 when the cleaning assembly 30 cleans the cleaning system 150 of the cleaning robot 10 (such problem makes it difficult to remove residue from the rack 221 and affects the smoothness of running of the cleaning assembly 30 relative to the base station body 21).

In other words, providing the rack 221 at the upper inner wall surface of the track groove 222 helps to reduce the difficulty of cleaning the track groove 222, which in turn helps to ensure that the cleaning sink 212 has a high degree of cleanliness and improves the smoothness and reliability of running of the cleaning assembly 30 along the track groove 222. Meanwhile, the noise generated when the cleaning assembly 30 runs relative to the track groove 222 can be reduced, thereby enhancing the user experience.

Figure 12:
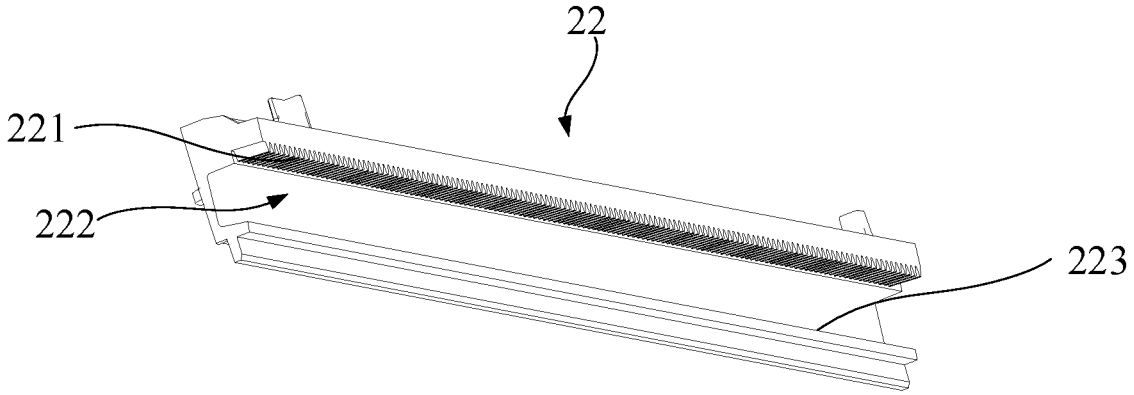
FIG. 12 is a schematic structural diagram of a track according to an optional embodiment of the present disclosure.
Figure 13:
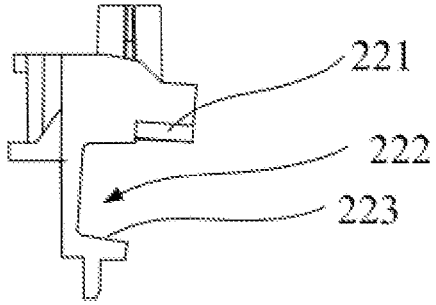
FIG. 13 is a schematic structural diagram of a perspective of the embodiment shown in FIG. 12.

In an example of the present disclosure, as shown in FIGS. 12 and 13, the base station 20 further includes a track 22 detachably connected to the base station body 21. The track 22 is provided with a track groove 222 and a rack 221. That is, the rack 221 for determining the running direction and supplying the running power for the cleaning assembly 30 to run relative to the base station body 21 and the track groove 222 for supplying support force for the cleaning assembly 30 running relative to the base station body 21 are both provided on the track 22, which helps to reduce the difficulty of assembling of the base station 20 and improve the production efficiency, and can reduce the noise generated during the running of the cleaning assembly 30, thereby being suitable for popularization and application Further, the track 22 is detachably connected to the base station body 21, which makes it possible to detach the track 22 from the base station body 21 for maintenance, cleaning, and replacement, and in turn helps to improve the maintenance efficiency, enhances the cleaning experience, and reduces the cost in replacement of parts, thereby being suitable for popularization and application.

On one hand, the one-piece structure of the rack 221 and the track 22 simplifies the assembling operation of the rack 221 and the track 22, and thereby helps to further reduce the difficulty of assembling of the track 22.

On the other hand, the rack 221 and the track 22 may be of a split structure; that is, the rack 221 may be mounted at an appropriate location of the track 22 such that the rack 221 can be easily detached from the track 22 to clean and repair the rack 221, and the track groove 222 can also be cleaned and repaired easily, which is simple in operation and thereby helps to reduce the maintenance cost and improve the cleaning experience.

In some possible embodiments according to the present disclosure, as shown in FIGS. 8, 9, 10 and 11, the base station body 21 includes a cleaning sink 212 below the cleaning assembly 30. The cleaning sink 212 is configured to accommodate residue removed by the cleaning assembly 30 from the cleaning system 150 of the cleaning robot 10, and/or to collect sewage generated during the cleaning of the cleaning system 150, thereby facilitating subsequent treatment of the debris and sewage and improving the cleanliness of the environment near the base station 20. It will be appreciated that the residue removed from the cleaning system 150 may include sewage, hair, debris, particulate dust, or other residue that meets the requirements, which is not specifically limited by the present disclosure.

By providing the track groove 222 on the inner wall of the cleaning sink 212, the track groove 222 is located in the interior of the cleaning sink 212. That is, the cleaning assembly 30 can move at an upper portion of the cleaning sink 212 along the track groove 222, which allows the residue which are generated when the cleaning assembly 30 cleans the cleaning system 150 of the cleaning robot 10 to reliably fall into the cleaning sink 212 and reduces the possibility of residue falling into the outside of the cleaning sink 212 and causing a secondary contamination, thereby improving the cleaning effect of the cleaning assembly 30.

Figure 10:
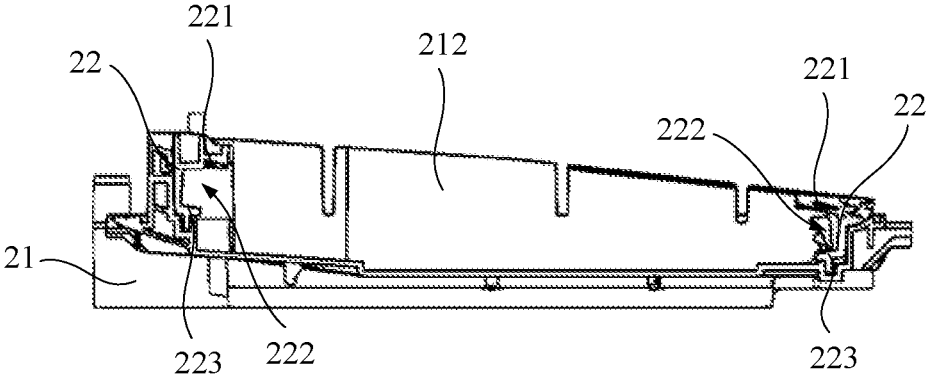
FIG. 10 is a cross-sectional view of a perspective of the embodiment shown in FIG. 8.

As shown in FIGS. 10 and 13, the lower inner wall surface of the track groove 222 is tilted downward toward the interior of the cleaning sink 212. For example, the lower inner wall surface of the track groove 222 is a first inner wall surface 223, the first inner wall surface 223 is connected to a groove opening of the track groove 222. The first inner wall surface 223 is tilted downward toward the interior of the cleaning sink 212 such that it is highly unlikely for residue entering the track groove 222 to be left on the first inner wall surface 223 when the cleaning assembly 30 cleans the cleaning system 150 of the cleaning robot 10. That is, the residue will flow into the interior of the cleaning sink 212 under the guidance of the first inner wall surface 223 which is tilted, which reduces the possibility that the residue left in the track groove 222 cause the cleaning assembly 30 to run poorly relative to the base station body 21 and corrode the track groove 222, and thereby improves the smoothness and reliability of running of the cleaning assembly 30 relative to the base station 20 and lengthens the service life of the track 22. Meanwhile, the residue within the track groove 222 flow into the cleaning sink under the guidance of the first inner wall surface 223, which reduces the possibility of secondary contamination caused by residue falling into the exterior of the cleaning sink 212, and also facilitates the centralized treatment of residue in the cleaning sink 212 to improve the treatment efficiency of debris.

Figure 6:
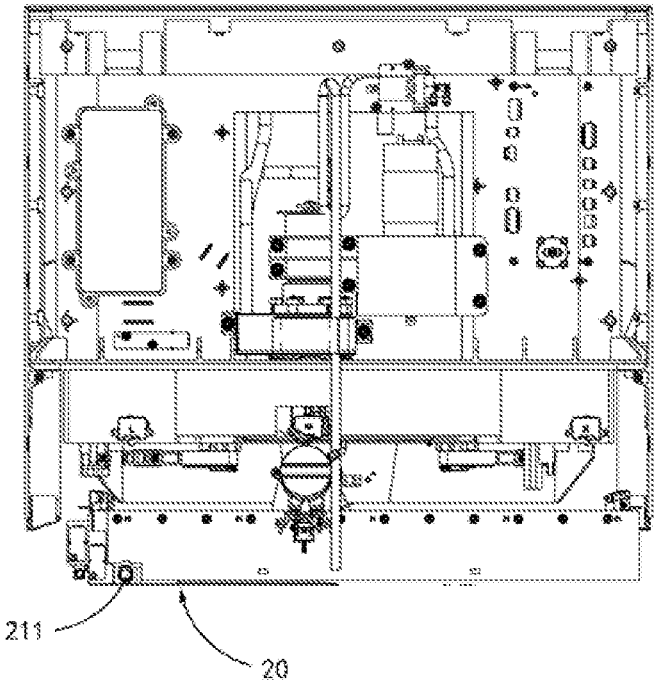
FIG. 6 is a schematic structural diagram of a perspective of an embodiment shown in FIG. 5.

In aforesaid embodiments, as shown in FIG. 6, the cleaning sink 212 is provided with a drain outlet 211, and the drain outlet 211 is disposed at a side of the cleaning sink 212. The residue inside the cleaning sink 212 can be removed to the outside of the cleaning sink 212 through the drain outlet 211.

As shown in FIG. 15, the cleaning assembly 30 further includes a clearing member 36 facing the bottom of the cleaning sink 212 such that the clearing member 36 can cause the residue in the cleaning sink 212 to go toward the drain outlet 211. For example, by configuring the clearing member 36 to abut the bottom of the cleaning sink 212, the clearing member 36 may bring the residue in the cleaning sink 212 toward the drain outlet 211 when the cleaning assembly 30 runs along the track groove 222 such that the residue can be discharged through the drain outlet 211 in a concentrated, fast and smooth manner, thereby improving the drainage efficiency and drainage effect of the base station 20 and improving the degree of satisfaction of users.

It will be appreciated that the base station 20 may further include a drainage mechanism. and the drainage mechanism is communicated with the drain outlet 211 to further improve the drainage effect of the base station 20 by transporting the residue in the cleaning sink 212 through the drain outlet 211 to the outside of the cleaning sink 212 by a suction action, a pumping action and the like of the drainage mechanism. Specifically, the drainage mechanism may include a fan assembly or a pump assembly, or a drainage assembly that meets the requirements, which is not specifically limited in the present disclosure.

Further, the base station 20 further includes a collecting box that is communicated with the cleaning sink 212 through the drain outlet 211 such that the residue in the cleaning sink 212 is transported to the collecting box through the drainage mechanism and the residue in the cleaning sink 212 can be prevented from overflowing, undermining the cleaning effect of the cleaning member and creating a dirty working environment. Thus, the provision of the collecting box helps to ensure a good cleaning effect and facilitates the centralized treatment of the collected debris.

In some possible embodiments according to the present disclosure, as shown in FIG. 14 and FIG. 16, the bracket 32 is further provided with a supporting portion 37, and the supporting portion 37 is spaced from the first gear 341 along the extending direction of the track groove 222. That is, the supporting portion 37 is distributed at two sides of the bracket 32 close to the track 22, and the supporting portion 37 includes a supporting wheel provided away from the bracket 32. The supporting wheel is disposed in the track groove 222, and the running of the supporting wheel along the track 22 can thereby support the cleaning assembly 30, which helps to improve the stability of running of the cleaning assembly 30 relative to the base station body 21. In addition, the provision of the supporting portion 37 allows the supporting portion 37 and the first gear 341 to support the bracket 32 simultaneously, which helps to reduce the support force of the first gear 341, lengthens the service life of the first gear 341, and reduces the noise generated when the first gear 341 runs along the rack 221.

In other words, in the base station 20, according to embodiments of the present disclosure, the driving portion 34 drives the first rotating shaft 345 to rotate, and the first gear 341 engages with the rack 221 on the track 22 of the base station body 21 to drive the bracket 32 to run relative to the base station body 21; and meanwhile, the supporting wheel of the supporting portion 37 runs along the track groove 222, which greatly improves the reliability and smoothness of running of the bracket 32 along the track groove 222 and is thereby suitable for popularization and application.

In an example of the present disclosure, as shown in FIG. 14 and FIG. 16, the cleaning assembly 30 further includes a first cleaning member 31 and a second cleaning member 33 provided on the bracket 32, and the first cleaning member 31 and the second cleaning member 33 herein are of different structures. Since the bracket 32 can move along the track groove 222 provided on the base station body 21 under the driving of the driving portion 34, the bracket 32, as a moving component, can drive the first cleaning member 31 and the second cleaning member 33 to move relative to the base station body 21 along with the bracket 32, which can remove the residue from the cleaning system 150 by causing the first cleaning member 31 to interfere with the cleaning system 150 of the cleaning robot 10 and causing the second cleaning member 33 to interfere with the cleaning system 150. That is, the cleaning robot 10 can achieve the automatic cleaning of the cleaning assembly. It will be appreciated that the residue may fall into the cleaning sink 212 after the first cleaning member 31 and the second cleaning member 33 remove the residue from the cleaning system 150.

The first cleaning member 31 includes a cleaning scraper, and the cleaning scraper interferes with the cleaning system 150 to remove the residue on the cleaning system 150. The second cleaning member 33 includes a cleaning roller, and the cleaning roller is rotatably provided relative to the bracket 32 and interferes with the cleaning system 150 to remove the residue from the cleaning system 150. Further, the cleaning roller is provided with brushes and/or blades on the outer surface, and the brushes and/or blades can go deep into the cleaning system 150 and remove the dirt hidden therein to further improve the cleaning effect.

The second cleaning member 33 and the first cleaning member 31 herein are provided in parallel on the bracket 32. The second cleaning member 33 may be provided in parallel at any side of the first cleaning member 31. If there is a plurality of second cleaning members 33, the second cleaning members 33 may also be distributed in parallel at any side or both sides of the first cleaning member 31; or if there is a plurality of first cleaning members 31, the first cleaning members 31 may be distributed in parallel at any side or both sides of the second cleaning member 33.

In an example of the present disclosure, the second cleaning member 33 may always be in front of the first cleaning member 31 when the driving portion 34 drives the bracket 32 to move reciprocally along the track groove 222. Under this configuration, the second cleaning member 33 may firstly clean the part to be cleaned (such as a cleaning head) of the cleaning system 150. That is, bristles or blades of the second cleaning member 33 may brush against the cleaning head when the second cleaning member 33 rotates, which causes the residue hidden in the cleaning head to be shaken out and scraped off under the vibration generated by the interference. Subsequently, the scraper of the first cleaning member 31 scrapes the residue brought out or shaken out of the cleaning head and also scrapes the sewage on the cleaning head to ensure that the cleaning head can be cleaned more thoroughly.

In some possible embodiments according to the present disclosure, the driving portion 34 is drivingly connected to the second cleaning member 33 to drive the second cleaning member 33 to rotate relative to the bracket 32. That is, the motor 342 of the driving portion 34 drives the first rotating shaft 345 to rotate and drives the second cleaning member 33 to rotate relative to the bracket 32 when the bracket 32 is driven to move along the track groove 222. Therefore, one motor 342 can simultaneously drive the bracket 32 to move relative to the base station body 21 and drive the second cleaning member 33 to rotate relative to the bracket 32, such as the self-rotation of the second cleaning member 33. Thus, the provision of the driving portion 34 can be simplified, which can meet the needs of the compact design of the product, helps to reduce the cost, and thereby is suitable for popularization and application.

In this embodiment, driving the cleaning assembly 30 to move in the left-right direction along the track groove 222 and driving the second cleaning member 33 to rotate by the driving portion 34 can be implemented by configuring the motor 342 to cooperate with multi-stage gears. For example, the driving portion 34 includes a motor 342 and a gear-driving assembly, and the second cleaning member 33 may rotate while the motor 342 drives the bracket 32 to move by means of the gear-driving assembly, which means that the gear assembly and the second cleaning member 33 are driven to rotate synchronously.

In this embodiment, the motor 342 can achieve the forward and reverse rotations. Thus, the motor can drive the bracket 32 to move in two opposite directions, and meanwhile drive the second cleaning member 33 to rotate in two directions (i.e., to rotate clockwise and counterclockwise). For example, the motor 342 can drive the bracket 32 to move to the left relative to the base station body 21 while driving the second cleaning member 33 to turn clockwise; and the motor 342 can drive the bracket 32 to move to the right relative to the base station body 21 while driving the second cleaning member 33 to turn counterclockwise. It should be noted that the type and size of each gear mentioned above is not limited here, and can be correspondingly selected according to actual needs.

In some possible embodiments according to the present disclosure, as shown in FIG. 14, the cleaning assembly 30 further includes a liquid-releasing device 35. When the cleaning assembly 30 cleans the cleaning system 150 of the cleaning robot 10, the liquid-releasing device 35 of the cleaning assembly 30 can work simultaneously and spray the cleaning liquid onto the cleaning system 150 to clean the cleaning system 150 under the impact force of the cleaning liquid, or wet the cleaning system 150 with the cleaning liquid to improve the cleaning effect when the cleaning member cleans the cleaning system 150.

Further, the liquid-releasing device 35 may spray the cleaning liquid onto the second cleaning member 33. Since the second cleaning member 33 is in contact with the cleaning system 150 of the cleaning robot 10 through rotation, the cleaning liquid sprayed on the second cleaning member 33 by the liquid-releasing device 35 can be evenly applied to the cleaning system 150 through the self-rotation of the second cleaning member 33, thereby ensuring a good cleaning effect. It will be appreciated that the liquid-releasing device 35 may also spray the cleaning liquid onto both the cleaning system 150 and the second cleaning member 33 to further improve the wetting efficiency of the cleaning system 150.

It will be appreciated that since the cleaning assembly 30 is located at the upper portion of the cleaning sink 212, the cleaning liquid will be accommodated in the cleaning sink 212 after cleaning the cleaning system 150 and discharged via a water outlet of the cleaning sink 212.

In aforesaid embodiments, the liquid-releasing device 35 of the base station 20 is movably provided, and the liquid-releasing device 35 may run with the track groove 222 along the bracket 32, such that the cleaning liquid can be more uniformly sprayed or applied to the cleaning system 150 of the cleaning robot 10 and/or the second cleaning member 33, and the cleaning effect and cleaning efficiency can be improved when the cleaning assembly 30 cleans the cleaning system 150 of the cleaning robot 10. It will be appreciated that overflow of the cleaning liquid into the external environment or onto the relevant electrical components of the cleaning robot 10 should be avoided to ensure safety of the electricity utilization of the cleaning robot 10 and the base station 20.

Further, the base station 20 further includes a liquid-supplying portion 40 and a liquid delivery channel. An end of the liquid delivery channel is communicated with the liquid-supplying portion 40, and the other end of the liquid delivery channel is communicated with the liquid-releasing device 35, such that the liquid-supplying portion 40 feeds the cleaning liquid to the liquid-releasing device 35 through the liquid delivery channel. At least a portion of the liquid delivery channel is movably provided with the bracket 32. The liquid-supplying portion 40 can store the cleaning liquid. and the liquid delivery channel is a transfer component that transfers the cleaning liquid to the liquid-releasing device 35.

Further, the liquid delivery channel is a liquid delivery tube, and the liquid delivery tube is connected to the bracket 32. That is, a liquid-releasing device 35 is provided on the bracket 32, and the two ends of the liquid delivery tube are communicated with the liquid-supplying portion 40 and the liquid delivery device 35 respectively to realize the liquid supply. The liquid delivery channel is provided with a pump body, and the cleaning liquid within the liquid-supplying portion 40 is transported to the liquid-releasing device 35 under the action of the pump body, which ensures that the cleaning liquid has a certain impact and has an increased cleaning capacity.

In embodiments of the present disclosure, as shown in FIG. 14, a plurality of liquid outlets 351 are provided at intervals on the liquid-releasing device 35, and the cleaning liquid is discharged through the liquid outlets 351 and can be discharged at a plurality of locations, thereby improving the cleaning efficiency.

On one hand, the liquid-releasing device 35 is a part of the bracket 32, and a plurality of liquid outlets 351 are provided at intervals on the bracket 32 to achieve the liquid discharging at a plurality of locations. On the other hand, the liquid-releasing device 35 may be fixedly provided on the base station body 21. For example, the liquid-releasing device 35 may include a plurality of liquid outlets 351, and the liquid outlets 351 are arranged from left to right along the base station body 21. When the cleaning assembly 30 moves relative to the base station body 21 in the right-left direction, the liquid-releasing sequence and the liquid-releasing frequency of the liquid outlet 351 may be configured according to the moving direction and moving speed of the cleaning assembly to ensure that the part to be cleaned can be wetted in advance when the cleaning assembly cleans the wet-cleaning system 153 of the cleaning robot 10, thereby improving the cleaning efficiency. In addition to this, a water pressure adjusting device and/or water temperature adjusting device can be provided for the liquid outlets 351 to adjust the water pressure and/or water temperature of the liquid outlets 351 according to the degree of dirtiness of the object to be cleaned and other factors, so as to further improve the cleaning efficiency.

In aforesaid embodiments, the liquid outlets 351 of the liquid-releasing device 35 may face toward at least one of the first cleaning member 31 and the second cleaning member 33, and the cleaning liquid released from the liquid outlets 351 can impact at least one of the first cleaning member 31 and the second cleaning member 33 to perform the cleaning. That is, the liquid outlets 351 not only serves as a channel allowing the cleaning liquid to enter the cleaning sink 212, but also enables the water flow to impact at least one of the first cleaning member 31, the second cleaning member 33 and the cleaning head of the wet-cleaning system 153 of the cleaning robot 10, so as to achieve the corresponding cleaning thereof.

In embodiments of the present disclosure, as shown in FIG. 14, the first cleaning member 31 and the second cleaning member 33 are provided in parallel to each other. The liquid outlets 351 of the liquid-releasing device 35 are located below the first cleaning member 31 and face toward the second cleaning member 33, and the liquid outlets 351 spray the cleaning liquid in the liquid-supplying portion 40 to the second cleaning member 33, and the second cleaning member 33 interferes with the cleaning head of the wet-cleaning system 153 of the cleaning robot 10 by the rotation of the second cleaning member 33 to apply the cleaning liquid to the cleaning head. It will be appreciated that the liquid-releasing direction of the liquid outlets 351 of the liquid-releasing device 35 may be directed toward the cleaning head, and the cleaning liquid may be directly sprayed onto the cleaning head, such that the cleaning of the cleaning head can be implemented under the impact of the cleaning liquid on the cleaning head and in conjunction with the first cleaning member 31 and the second cleaning member 33.

The present disclosure has been illustrated by aforesaid embodiments, but it should be understood that the aforesaid embodiments are merely exemplary and illustrative, and are not intended to limit the present disclosure to the scope of the embodiments as described. Further, it may be understood by those skilled in the art that the present disclosure is not limited to the aforesaid embodiments and that more variations and modifications may be made in accordance with the teachings of the present disclosure, all of which fall within the protection scope as claimed by the present disclosure. The protection scope of the present disclosure is defined by the appended claims and their equivalent scope.

What is claimed is:

1. A base station for cleaning a cleaning system of a cleaning robot, the base station comprising:

a base station body provided with two track grooves wherein the two track grooves are provided opposite each other along a lateral direction of the base station body;

a cleaning assembly configured to run along at least one of the two track grooves and provided with a cleaning member, wherein the cleaning member is configured to clean the cleaning system of the cleaning robot by interfering with the cleaning system of the cleaning robot; and at least one track-cleaning member configured to run along the at least one of the two track grooves to clean the at least one of the two track grooves:

wherein the at least one track-cleaning member is provided on the cleaning assembly, and comprises a sweeping member inside the at least one of the two track grooves;

wherein the at least one track-cleaning member is provided at a side of the cleaning assembly;

wherein the cleaning assembly comprises a bracket capable of running along the two track grooves, and wherein the at least one track-cleaning member comprises multiple track- cleaning members which are provided at two ends of the bracket.

2. The base station according to claim 1, wherein the at least one track-cleaning member is provided slantwise towards an outer side of the cleaning assembly.

3. The base station according to claim 2, wherein the at least one track-cleaning member is arranged not perpendicularly to an extending direction of the at least one of the two track grooves, and is arranged as being tilted toward an end portion of the at least one of the two track grooves.

4. The base station according to claim 1, wherein:

one of the track-cleaning members is provided at an end of the bracket facing one of the two track grooves, and the one of the track-cleaning members is provided slantwise towards an end portion of one of the two track grooves and disposed at a location of the bracket close to the end portion; and/or two of the track-cleaning members are provided at an end of the bracket facing one of the two track grooves, two of the track-cleaning members comprising a first track-cleaning member and a second track-cleaning member, the first track-cleaning member is provided slantwise towards a first end portion of the one of the two track grooves and is disposed at a location of the bracket close to the first end portion, and the second track-cleaning member is provided slantwise towards a second end portion of one of the two track grooves and is disposed at a location of the bracket close to the second end portion.

5. The base station according to claim 1, wherein the at least one track-cleaning member comprises a mounting portion connected to the sweeping member, the mounting portion being detachably connected to the cleaning assembly.

6. The base station according to claim 1, further comprising:

a rack provided on the base station body, wherein the cleaning assembly comprises a driving portion and a first gear linked to the driving portion, the first gear is disposed at two ends of the bracket, and the driving portion is configured to drive the first gear to engage with the rack to drive the bracket to run along the two track grooves.

7. The base station according to claim 6, wherein the rack is provided inside the at least one of the two track grooves.

8. The base station according to claim 7, wherein the base station body comprises a cleaning sink below the cleaning assembly, the at least one of the two track grooves is provided on an inner wall of the cleaning sink, a lower inner wall surface of the at least one of the two track grooves is tilted downward towards an interior of the cleaning sink, and the rack is provided on an upper wall surface of the at least one of the two track grooves.

9. The base station according to claim 8, wherein the cleaning sink is provided with a drain outlet, and the cleaning assembly further comprises a clearing member facing a bottom of the cleaning sink, the clearing member being configured to bring residue in the cleaning sink towards the drain outlet.

10. The base station according to claim 8, wherein the cleaning assembly further comprises:

a device configured to release a cleaning liquid, the cleaning liquid being accommodated in the cleaning sink after cleaning the cleaning system.

11. The base station according to claim 10, wherein a plurality of liquid outlets are provided at intervals on the device configured to release the cleaning liquid.

12. The base station according to claim 6, wherein the base station further comprises a track detachably connected to the base station body, the track is provided with the at least one of the two track grooves and the rack, and the track is formed with the rack integrally or separately.

13. The base station according to claim 6, wherein a supporting portion is provided on the bracket, the supporting portion is spaced from the first gear in an extending direction of the at least one of the two track grooves and comprises a supporting wheel provided away from the bracket, the supporting wheel being in the at least one of the two track grooves.

14. The base station according to claim 6, wherein the cleaning assembly further comprises:

a first cleaning member and a second cleaning member that are provided on the bracket;

wherein the first cleaning member and the second cleaning member remove residue from the cleaning system by interfering with the cleaning system of the cleaning robot.

15. The base station according to claim 14, wherein the driving portion is further drivingly connected with the second cleaning member to drive the second cleaning member to rotate relative to the bracket.

16. A cleaning robot system comprising:

a cleaning robot comprising a cleaning system; and a base station;

wherein the base station comprises:

a base station body provided with two track grooves, wherein the two track grooves are provided opposite each other along a lateral direction of the base station body;

a cleaning assembly configured to run along at least one of the two track grooves and provided with a cleaning member, wherein the cleaning member is configured to clean the cleaning system of the cleaning robot by interfering with the cleaning system of the cleaning robot; and at least one track-cleaning member configured to run along the at least one of the two track grooves to clean the at least one of the two track grooves;

wherein the at least one track-cleaning member is provided on the cleaning assembly, and comprises a sweeping member inside the at least one of the two track grooves;

wherein the at least one track-cleaning member is provided at a side of the cleaning assembly:

wherein the cleaning assembly comprises a bracket capable of running along the two track grooves, and wherein the at least one track-cleaning member comprises multiple track-cleaning members which are provided at two ends of the bracket.

* * * * *